US011115752B2

(12) United States Patent
Stumpner

(10) Patent No.: US 11,115,752 B2
(45) Date of Patent: Sep. 7, 2021

(54) SOUND TRANSDUCER

(71) Applicant: INSTITUT FÜR RUNDFUNKTECHNIK, Munich (DE)

(72) Inventor: Roman Stumpner, Munich (DE)

(73) Assignee: INSTITUT FÜR RUNDFUNKTECHNIK, Munich (DE)

( * ) Notice: Subject to any disclaimer, the term of this patent is extended or adjusted under 35 U.S.C. 154(b) by 0 days.

(21) Appl. No.: 16/754,542

(22) PCT Filed: Oct. 11, 2017

(86) PCT No.: PCT/IB2017/056268
§ 371 (c)(1),
(2) Date: Apr. 8, 2020

(87) PCT Pub. No.: WO2019/073283
PCT Pub. Date: Apr. 18, 2019

(65) Prior Publication Data
US 2020/0275195 A1 Aug. 27, 2020

(51) Int. Cl.

| | |
|---|---|
| ***H04R 3/00*** | (2006.01) |
| ***H04R 1/28*** | (2006.01) |
| ***H04R 1/10*** | (2006.01) |
| ***H04R 5/033*** | (2006.01) |
| ***H04S 7/00*** | (2006.01) |

(52) U.S. Cl.
CPC ..... *H04R 1/2869* (2013.01); *H04R 1/1091* (2013.01); *H04R 5/033* (2013.01); *H04S 7/30* (2013.01)

(58) Field of Classification Search
CPC ..... H04R 3/00
See application file for complete search history.

(56) References Cited

U.S. PATENT DOCUMENTS 8,737,664 B2 * 5/2014 Tiscareno ..... H04R 1/2896 381/370
2006/0126855 A1 * 6/2006 Geiger ..... H04R 5/027 381/56

(Continued)

FOREIGN PATENT DOCUMENTS

WO 2014138735 A1 9/2014

OTHER PUBLICATIONS

PCT/IB2017/056268. International Search Report & Written Opinion (dated Apr. 18, 2019). 18 Pages.

*Primary Examiner* — Olisa Anwah
(74) *Attorney, Agent, or Firm* — Kevin L. Soules; Loza & Loza, LLP

(57) ABSTRACT

According to the present invention, an apparatus, a signal processing unit, data, a processing apparatus, a sound converter, a software product and a method are proposed. The apparatus is proposed for acoustic reproduction, wherein the apparatus is provided with a first electroacoustic sound transducer for generating a sound field, the first electroacoustic sound transducer having an input for receiving an electrical signal for generating the corresponding sound field, wherein the apparatus is characterized in that also a device is provided which is configured to enter into an acoustic interaction with the generated sound field of the first electroacoustic sound transducer in order to generate a modified sound field and wherein the modified sound field has a predetermined acoustic impedance value.

16 Claims, 6 Drawing Sheets

(56) References Cited

U.S. PATENT DOCUMENTS

2007/0154049 A1 7/2007 Levitsky et al.
2008/0107287 A1* 5/2008 Beard ..... H04R 1/1016 381/111
2008/0170710 A1* 7/2008 Pasternak ..... H04R 1/2849 381/74
2011/0139541 A1* 6/2011 Schuermans ..... F01N 1/023 181/259
2013/0058493 A1* 3/2013 Darlington ..... H04R 1/1083 381/71.6
2013/0336513 A1* 12/2013 Darlington ..... H04R 1/1075 381/380
2014/0003645 A1* 1/2014 Silver ..... H04R 1/288 381/351
2014/0363003 A1* 12/2014 Kupershmidt ..... H04R 29/001 381/58
2015/0181322 A1* 6/2015 Huang ..... H04R 1/1016 381/380
2015/0382100 A1* 12/2015 Azmi ..... H04R 1/1016 381/380
2016/0044405 A1* 2/2016 Huang ..... H04R 1/32 381/74
2016/0066111 A1* 3/2016 Epping ..... G10K 11/22 381/328
2016/0088380 A1* 3/2016 Stauber ..... H04R 1/02 381/71.2
2016/0146039 A1* 5/2016 Braden ..... F02C 7/045 415/119
2016/0261944 A1* 9/2016 Silvestri ..... H04R 1/2826
2016/0269833 A1* 9/2016 Norris ..... H04R 17/005
2018/0055421 A1* 3/2018 Norgaard ..... G01H 15/00
2018/0084337 A1* 3/2018 Schmidt ..... H04R 1/345
2018/0359578 A1* 12/2018 Boley ..... H04R 25/652
2020/0260194 A1* 8/2020 Cherigui ..... H04R 25/558
2020/0404410 A1* 12/2020 Azmi ..... H04R 1/2826
2021/0127199 A1* 4/2021 Clark ..... H04R 1/2857

* cited by examiner

SOUND TRANSDUCER

CROSS-REFERENCE TO RELATED APPLICATIONS

This application is the U.S. National Stage of International Patent Application No. PCT/IB2017/056268 filed on Oct. 11, 2017, the disclosures of the foregoing application being incorporated herein by reference in its entirety for all applicable purposes.

TECHNICAL FIELD

The present invention is directed at a device, a method, a signal processing unit, data for acoustic reproduction, a sound transducer, in particular a headphone or an earphone, and a software product for improving sound reproduction.

BACKGROUND

Problems with the reproduction of sound signals via headphones are known from the prior art, so that when sound events are emitted via headphones, under certain conditions these sound events are perceived by the human ear in a significantly different way as with sound sources that are distant from the ear such as loudspeakers. Despite the use of external ear transmission functions, spatial imaging errors (elevation angle) can occur if the sound source is in the median plane (imaginary plane perpendicular between the ears) of the listener. With such correlated signals, interaural levels and transit time differences are missing. Especially with sound sources located in front, the sound signals are often perceived as in the head or very close to the head (so-called in-head localization). The IHL often occurs in connection with a disturbing elevation (localization at the top of the head). So far, these problems can only be improved through technically complex optical support or through head tracking. Further imaging errors relate to the perceived volume of sound signals that are emitted via headphones. Headphones may be perceived as quieter than distant sound sources, even though the sound pressure level is the same. It has been shown that this so-called SLD effect (Sound pressure Loudness Divergence) always occurs together with the in-head localization.

The present invention is therefore based on the object of eliminating or at least reducing the above problems in order to achieve an improved sound reproduction.

This object is solved according to the invention based on one of the claims listed, in particular based on the following descriptions and figures.

BRIEF SUMMARY

According to a first aspect of the present invention, an apparatus for acoustic reproduction is proposed, the apparatus being provided with a first electroacoustic sound transducer for generating a sound field, the first electroacoustic sound transducer having an input for receiving an electrical signal for generating the corresponding sound field, wherein the apparatus is characterized in that a device is also provided which is configured to enter into an acoustic interaction with the generated sound field of the first electroacoustic sound transducer in order to generate a modified sound field and wherein the modified sound field has a predetermined acoustic impedance value.

According to a further aspect of the present invention, an apparatus is proposed, wherein the device is at least one acoustic resonator and/or at least one further electroacoustic sound transducer. An electroacoustic sound transducer is therefore generally proposed in accordance with the present invention either in cooperation with at least one further electroacoustic sound transducer or in cooperation with at least one resonator. For both of the aforementioned embodiment variants, an acoustic interaction is provided in order to generate a modified sound field, so that the modified sound field has a predetermined acoustic impedance value. Further alternatively, according to the invention it is provided that both of the aforementioned variants are configured to set different impedance values or variable impedance values for the modified sound field.

According to the invention, an apparatus according to one of the above alternative embodiments is proposed, wherein the first electroacoustic sound transducer and/or the further electroacoustic sound transducer is configured to receive an electrical signal based on an impedance information and to convert it into an acoustic signal so that the modified acoustic field has a predetermined acoustic impedance value through the corresponding acoustic interaction.

According to a further advantageous aspect of the present invention, an apparatus is proposed, wherein the at least one acoustic resonator is designed as a recess, hole or as a Helmholtz resonator, those being implemented in particular on the housing of the device, in particular in the inner and/or outer housing area.

Furthermore, an apparatus of the above type is proposed according to the invention, wherein the first electroacoustic sound transducer and/or the further electroacoustic sound transducer and/or the acoustic resonator are controllable by a corresponding electrical signal in order to set different acoustic impedance values in the modified sound field. In this case, control can take place either directly via the electrical audio signal to be fed in and/or via a separate signaling.

Further advantageously, one of the apparatus of the above type is proposed, wherein the apparatus has a measuring unit, in particular a microphone for measuring a sound field parameter in order to be able to derive a given impedance value in the sound field therefrom, to enable the generation of a subsequent electrical adaptation signal. It is expressly pointed out here that one or more of the embodiments proposed according to the invention are either configured to receive an already prepared signal for setting an acoustic impedance value and to generate the corresponding modified sound field, or to actively carry out a measurement via a control loop in order to measure a current impedance value in the sound field in order to implement subsequent readjustment by generating a suitable signal.

It is further advantageous that one of the above apparatus according to the invention is designed as headphones or as earphones, in particular a corresponding housing can be provided for accommodating the device according to the invention and can be designed as a helmet.

Further advantageously, an apparatus is proposed in which the position and/or the orientation of the first electroacoustic sound transducer and/or of the further electroacoustic sound transducer and/or of the acoustic resonator is designed to be changeable and in particular can be changed by a suitable electrical signal and adjusted if necessary. In particular, variability in the position and/or orientation of a sound transducer or resonator is protected. Furthermore, in the case of a resonator, the frequency response and/or the oscillating mass can be designed to be controllable.

According to a further aspect, a signal processing unit for processing signals for acoustic reproduction is proposed, which is characterized in that the signal processing unit is configured to process a further signal for acoustic interaction with a first sound field, based on a first signal which is provided for generating the first sound field, to generate a modified sound field, wherein the modified sound field has a predetermined acoustic impedance value.

Further advantageously, a signal processing unit is proposed, the signal processing unit providing a factor based on at least one sound pressure signal and/or one sound velocity of the first signal to generate a modified sound field, wherein the modified sound field has a predetermined acoustic impedance value.

Further advantageously, a signal processing unit is proposed, wherein the sound pressure signal and/or the sound velocity is derived by a measurement, particularly from of at least one microphone.

Further advantageously, a signal processing unit is proposed, wherein the signal processing unit is configured to process an impedance signal for the impedance signal being providable to a sound transducer.

Further advantageously, a signal processing unit is proposed, wherein the modified sound field has a temporally predetermined variable acoustic impedance value.

Further advantageously, a signal processing unit is proposed, wherein the signal processing unit is configured to process further relevant acoustic parameters, in particular geometric parameters of a headphone or an earphone, in order to set the predetermined acoustic impedance value for the modified sound field.

Further advantageously, data for acoustic reproduction is proposed, characterized in that the data has data elements for acoustic interaction with a first sound field, wherein the data elements are configured to generate a modified sound field, the modified sound field having a predetermined acoustic impedance value.

Further advantageously, data is proposed, wherein the data elements are configured to be converted into a corresponding electrical signal in order to be reproduced in a later step by an acoustic resonator and/or by at least one electroacoustic sound transducer.

Further advantageously, the data elements comprise impedance information.

Further advantageously, data is proposed, wherein the data comprises control data for controlling the acoustic resonator and/or the at least one electroacoustic sound transducer.

Further advantageously, data is proposed, wherein the data is being generated by one of the above-described signal processing units according to the invention.

Further advantageously, a processing unit for processing and/or reproducing the data is being proposed, wherein the data is in accordance with one of the above data variants and wherein the data processing unit is in particular a smartphone, a notebook, a laptop, a tablet PC, a personal computer, a wireless transmitter or a server.

Further advantageously, a sound transducer is proposed, wherein the sound transducer is configured to reproduce a generated signal by a signal processing unit according to one of the above embodiments and/or data according to one of the above embodiments.

Further advantageously, a software product that can be stored on a storage medium and processed by an electronic data processing unit to implement a signal processing unit according to one of the above embodiments and/or to generate or reproduce data according to one of the above embodiments. According to the invention, a method for acoustic reproduction is proposed, the method comprising the following steps: generating a first sound field and generating a second signal for acoustic interaction with the first sound field in order to generate a modified sound field, wherein the modified sound field has a predetermined acoustic impedance value.

Thus, according to the invention, information about the sound field impedance at the ear input is also taken into account in addition to the sound pressure, in order to reliably obtain spectral information for sound source localization even with correlated signals from the median level. However, the hearing can only derive such impedance information from the position of the eardrum at the end of the auditory canal.

The invention is characterized in particular by the fact that a headphone or earphone according to the invention not only simulates the sound pressure signal, but also the sound field impedance generated by a distant sound source on the ear in order to improve or completely avoid negative phenomena such as the IHL or SLD. In contrast to the current binaural technology, the headphones ideally do not receive a sound pressure signal that contains head-related sound pressure frequency responses, as these develop by themselves if the sound field impedance in the headphones is set correctly. The so-called head-related transfer function (HRTF) then only describes the relationship between the two ears. The procedure below describes how the sound field impedance, which is considered relevant for hearing, is defined and how it can be measured.

BRIEF DESCRIPTION OF THE FIGURES

The accompanying figures, in which like reference numerals refer to identical or functionally-similar elements throughout the separate views, which are incorporated in and form a part of the specification, further illustrate the embodiments and, together with the detailed description, serve to explain the embodiments disclosed herein.

DETAILED DESCRIPTION

According to the invention, a method for measuring head-related sound field impedances of headphones is disclosed.

Figure 1:
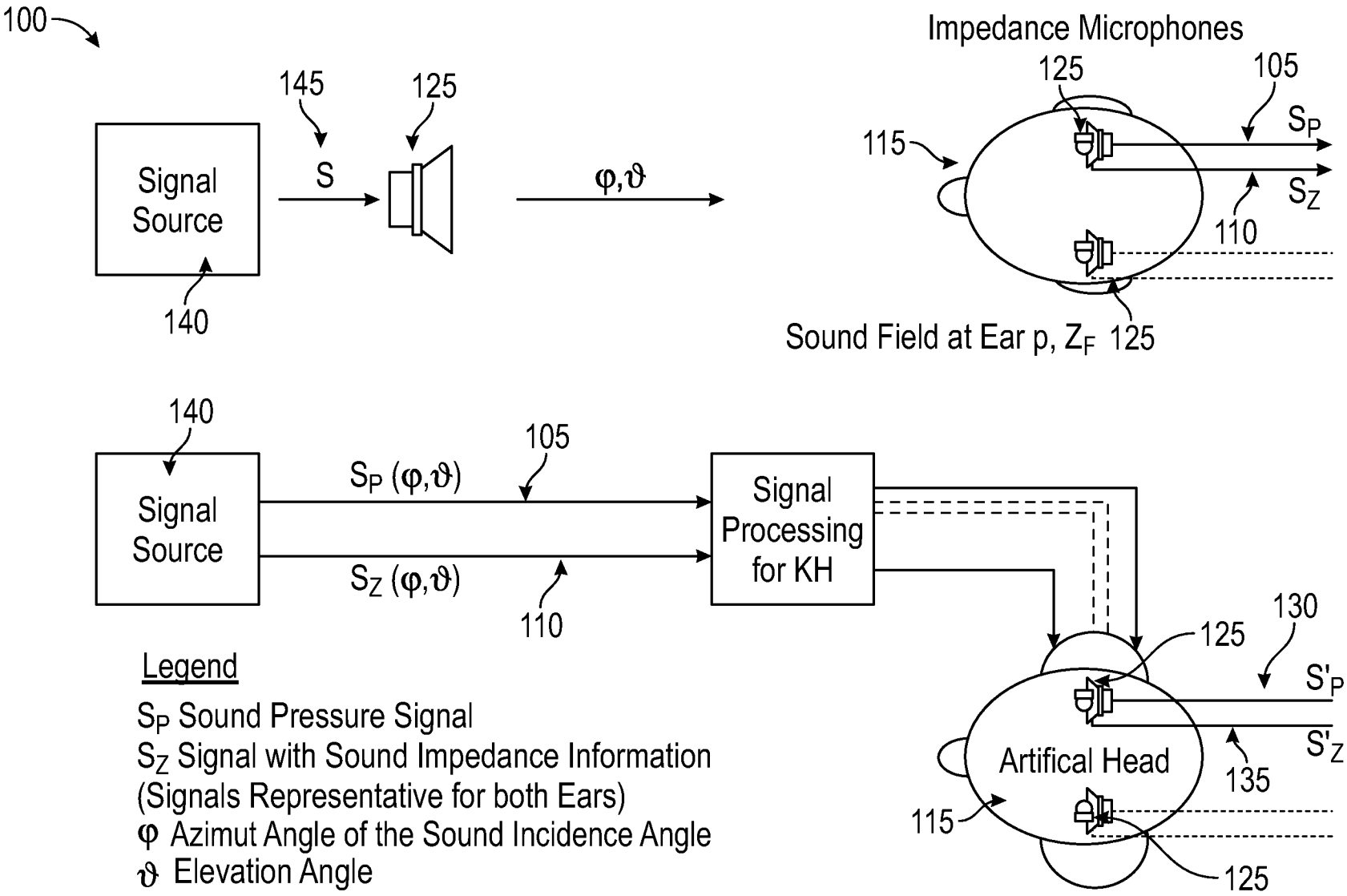
FIG. 1 illustrates components of a system suitable for loudspeaker and headphone sonification, in order to determine a signal which depends on the sound pressure, and a signal which depends on the sound pressure and the sound field impedance, in accordance with features of the embodiments.

For the development of a headphone, a measurement method is necessary that indicates whether a headphone generates a sound field impedance which is relevant in regard to the avoidance of IHL and SLD. This is necessary if the measurement method for headphone sonification delivers the same result as with loudspeaker sonification. The proposed measuring method extends the known method for determining the head-related sound pressure transfer function (HRTF) by a second transfer function, which contains information about the sound field impedance. With the help of a suitable artificial head having at the end of each ear canal a so-called impedance microphone, which is able to provide both a pressure signal and a speed signal from a power source (see below), a system 100 can be set-up which is suitable for loudspeaker and headphone sonification, in order to determine a signal $S_p$ 105 which depends on the sound pressure and a signal $S_z$ 110 which depends on the sound pressure and the sound field impedance as illustrated in FIG. 1.

When the artificial head 115 is exposed to loudspeaker 120 sonification by signal S 145, the signals $S_p$ 105 and $S_z$ 110 are produced by a signal source 140 at the outputs of the microphones 125 for the left and right ear. These signals depend on the frequency and the angle of incidence. If the artificial head 115 is now irradiated with the same signals via headphones (with signal processing, if applicable), the signals $S'_p$ 130 and $S'_z$ 135 are measured.

Equation (1) applies to headphones that are also supplied with the signal $S_p$ 105 and that simulate sound field conditions comparable to a loudspeaker on the ear:

$$S'_p = k\,S_p \text{ and } S'_z = k\,S_z. \tag{1}$$

It should be noted that the system 100 for the headphones does not have to be an artificial head. A comparable measurement method, which is, however, limited to sound pressure, has been used in binaural technology for a long time in order to generate spatially perceptible sound fields in headphones. A sound pressure transfer function $H_p$, shown in equation (2), can be determined from the measured signal $S_p$ 105 which no longer contains the loudspeaker frequency response by relating the head-related signals to the pressure signals of a free-field measurement without a head:

$$H_p = p_{EAR}/p_{FREE\text{-}FIELD} \tag{2}$$

$H_p$ describes the change in sound pressure caused by the presence of a human head (body) and the relationship between the ears. This function, which is also referred to in the current binaural technology as the head-related transfer function (or HRTF), must, however, be corrected in a new headphone with sound field impedance reproduction by the sound pressure which is generated by this field impedance. Ideally, $H_p$ then only contains interaural relationships.

The signal $S_z$ 110 is new and provides, in comparison to the pure sound pressure signal $S_p$ 105, additional information about the sound field in front of the ear. It describes the acoustic resistance at the ear entrance of a human head which is felt by a force source Q located in the ear canal if it exerts a force $F_Q$ against an external sound field. The force $F_Q$ is derived from the pressure in the ear canal by a suitable mechanism (a microphone, not described in more detail) and reacts in phase with the pressure on the sound field. For this reason, the signal $S_z$ 110 also depends on the sound pressure. The force source Q is itself exposed to the force $F_F$ of the external sound field. The force source Q thus impresses a force $D_{FQ}=F_Q-F_F$ into the sound field and reacts with the speed $v_Q$ to the sound field impedance $Z_F$. Thus, $v_Q$ is therefore generally a function of sound pressure p and sound field impedance $V_F$:$v_Q=f(p, Z_F)$ Similar to the head-related sound pressure transfer function $H_P$, an impedance transfer function $H_Z$, shown as equation (3), can be determined from the signal $v_Q$ by relating $v_Q$ to the signal of a free-field measurement without head:

$$H_z = v_{Q\text{-}ear}/V_{Q\text{-}FREE\text{-}FIELD} \tag{3}$$

$H_z$ thus represents an extension of the previous head-related properties and can be used to characterize the properties of headphones with regard to the acoustic sound field impedance in front of the ear.

The application of the described method for measuring the signal $S_z$ 110 combined with a pressure sensor is referred to as an impedance microphone. It is able to deliver both a sound pressure signal and a signal based on the sound field impedance.

According to the invention, sound field impedance measurements are carried out on the outer ear of a test person with the aid of the 2-microphone method in order to characterize the differences in the sound irradiation with headphones and loudspeakers. With this, correlations to the subjective hearing sensations IHL and SLD are also examined. It turned out that a measurement of the X-component of the sound field impedance depicts the differences quite well and gives an idea about the value and the frequency dependency and angle dependency of the sound field impedance.

These impedance measurements are not identical to those made from the ear canal using impedance microphones and the method described above. They only apply to one component of the sound field in front of the ear.

According to the invention, the following methods for influencing the sound field impedance in front of the ear in a headphone or earphone are provided.

For a headphone or earphone that is characterized by an improvement in the localization in the median plane, in particular with regard to the frontal location, the sound field conditions in front of the ear of a human head are to be modeled as if exposed to sound from a distant sound source. Ideally, a head-related impedance signal and a frequency-independent sound pressure signal are transmitted to the headphones. An oscillation converter outputs a proportional speed signal to the headphone chamber and generates the corresponding head-related sound pressure at the specified sound field impedance. Alternatively, simplified systems can also be useful, in which the most important properties of the real sound field impedance at the ear are transmitted to a headphone.

An embodiment according to the invention with modeling approximating reality is characterized by one or more of the following properties:

a) the sound field impedance in front of the ear should have a predominantly positive reactance in the frequency range from approximately 100 Hz to 2.5 kHz; and/or b) in the case of sound from a distant sound source from the front direction, two typical sound pressure minima arise at the ear. They are usually in narrow frequency ranges around 1 kHz and 2.5 kHz, depending on the head and body geometry. These arise from minima in the sound field impedance as a result of interference. According to the invention, these sound pressure minima are not transferred to the headphones as a sound pressure signal, rather the headphones must adopt the corresponding sound field impedance, so that these sound pressure minima arise as a result thereof; and/or c) in order to realize directional hearing in the entire median plane, the minima in the sound field impedance are shifted to low frequencies with increasing sound incidence angle, in accordance with what happens at the head in case of sonication with a distant sound source. When sound comes from behind, the minima in the sound field impedance are strongly damped or disappear completely; and/or d) according to the invention, in particular a calibration option is implemented on the headphones in order to be able to optimally compensate for individual differences between listeners. This can include the magnitude of the sound field impedance as well as the location of the characteristic minima.

The apparatus, procedures and methods according to the invention which are able to influence the sound field impedance of a headphone are presented below.

Figure 2:
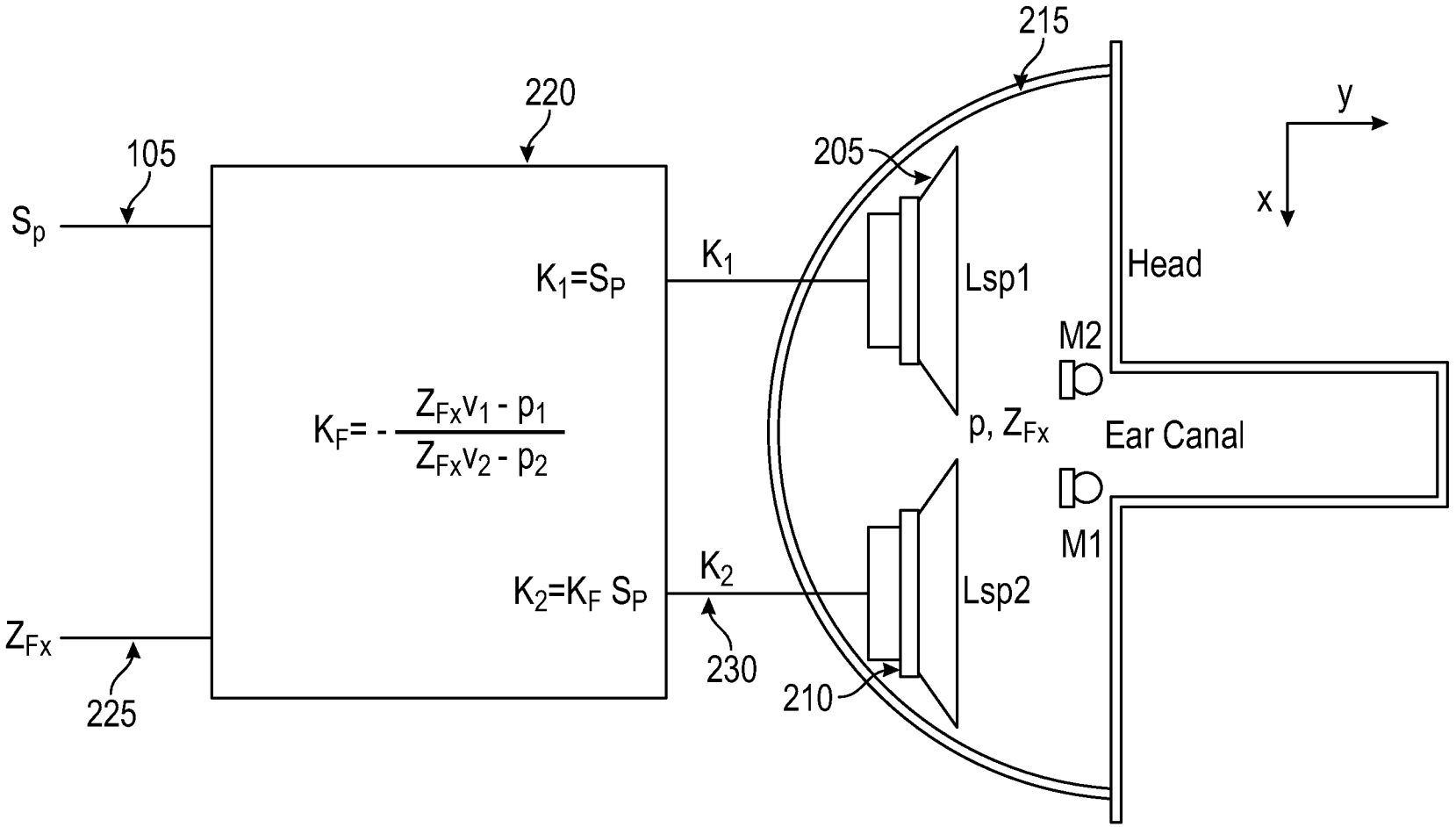
FIG. 2 illustrates a block diagram of a system wherein sound field impedance is modeled using pairs of sound transducers, in accordance with features of the embodiments.

According to an embodiment of the invention and with reference to FIG. 2, the sound field impedance is modeled using pairs of sound transducers 205 and 210. For this purpose, according to the invention, in addition to the sound pressure at the ear, a certain sound field impedance is achieved by using two sound transducers 205 and 210 in one headphone capsule 215. With suitable signal processing provided by signal processing unit 220, the desired sound field impedance can be influenced in the arranged direction. For this purpose, the sound pressures $P_1$, $P_2$ and the sound velocities $v_1$, $v_2$ of the individual sound transducers 205 and 210 are first determined through a suitable impedance measurement method (2-microphone method) or through previously determined sound pressures and sound speeds based on geometry-related values. A factor $k_F$ can then be calculated therefrom which describes the signal difference between the two sound transducers 205 and 210. Several directions can be influenced by arranging additional loudspeaker pairs in other directions.

Signal conditioning can be used to calculate the signal $K_2$ 230 for the second loudspeaker based on the value of the sound field impedance at the input. The signal processing can also be part of a computer simulation if $Z_{Fx}$ 225 changes over time, such as with moving sound sources or when using head trackers. $P_1$, $P_2$ and $v_1$, $v_2$ are determined from individual measurements of the sound transducers 205 and 210 ($L_{sp1,2}$) using the 2-microphone method. $S_p$ is the sound pressure signal and $Z_{Fx}$ is the impedance information.

Figure 3B:
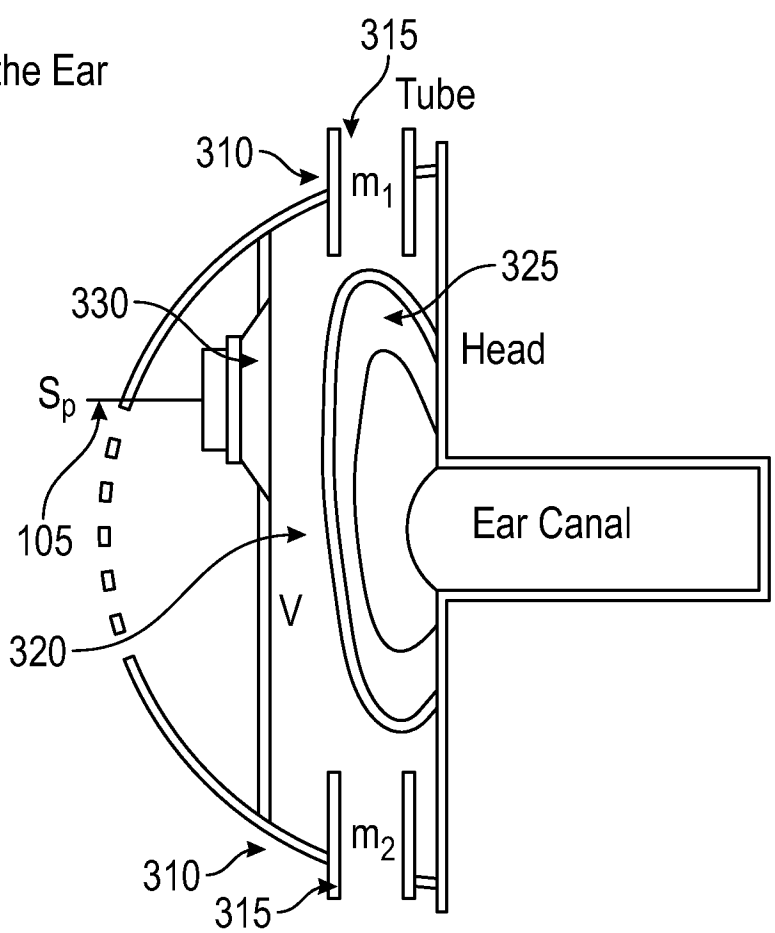
FIG. 3B illustrates a block diagram of a system for modeling sound field impedance with passive acoustic resonators, in accordance with features of the embodiments.
Figure 3A:
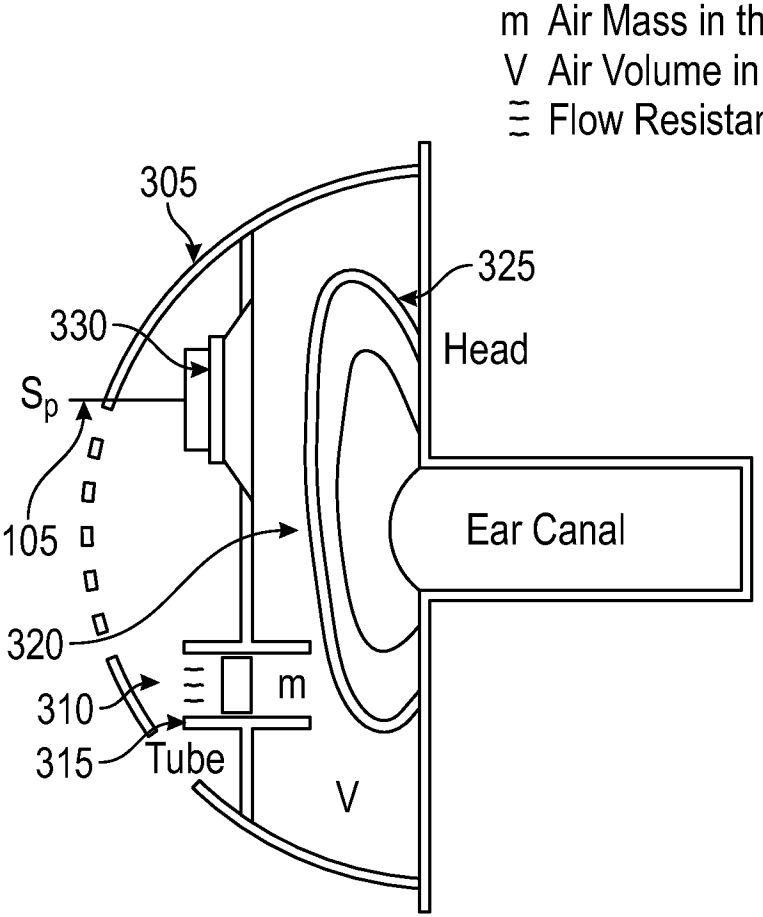
FIG. 3A illustrates a block diagram of a system for modeling sound field impedance with a passive acoustic resonator, in accordance with features of the embodiments.

According to a further embodiment of the present invention and with reference to FIGS. 3A and 3B, modeling of the sound field impedance with passive acoustic resonators is proposed. With the help of Helmholtz resonators, the sound field impedance in headphones 305 can be changed to positive reactances. The resonator 310 includes a tube 315 with an arbitrarily shaped cross-sectional area, the opening of which protrudes into the volume 320 between the ear 325 and the sound transducer 330. Other resonators may be used instead. The accelerated air in the tube 315 represents a mass that, together with the stiffness of the air volume, forms a resonance system. Above the resonance frequency. The mass character of the sound field occurs above the resonance frequency. The bandwidth and quality of the system can also be influenced with a flow resistance. Several resonators in combination can also be implemented as illustrated in FIG. 3B.

Figure 4:
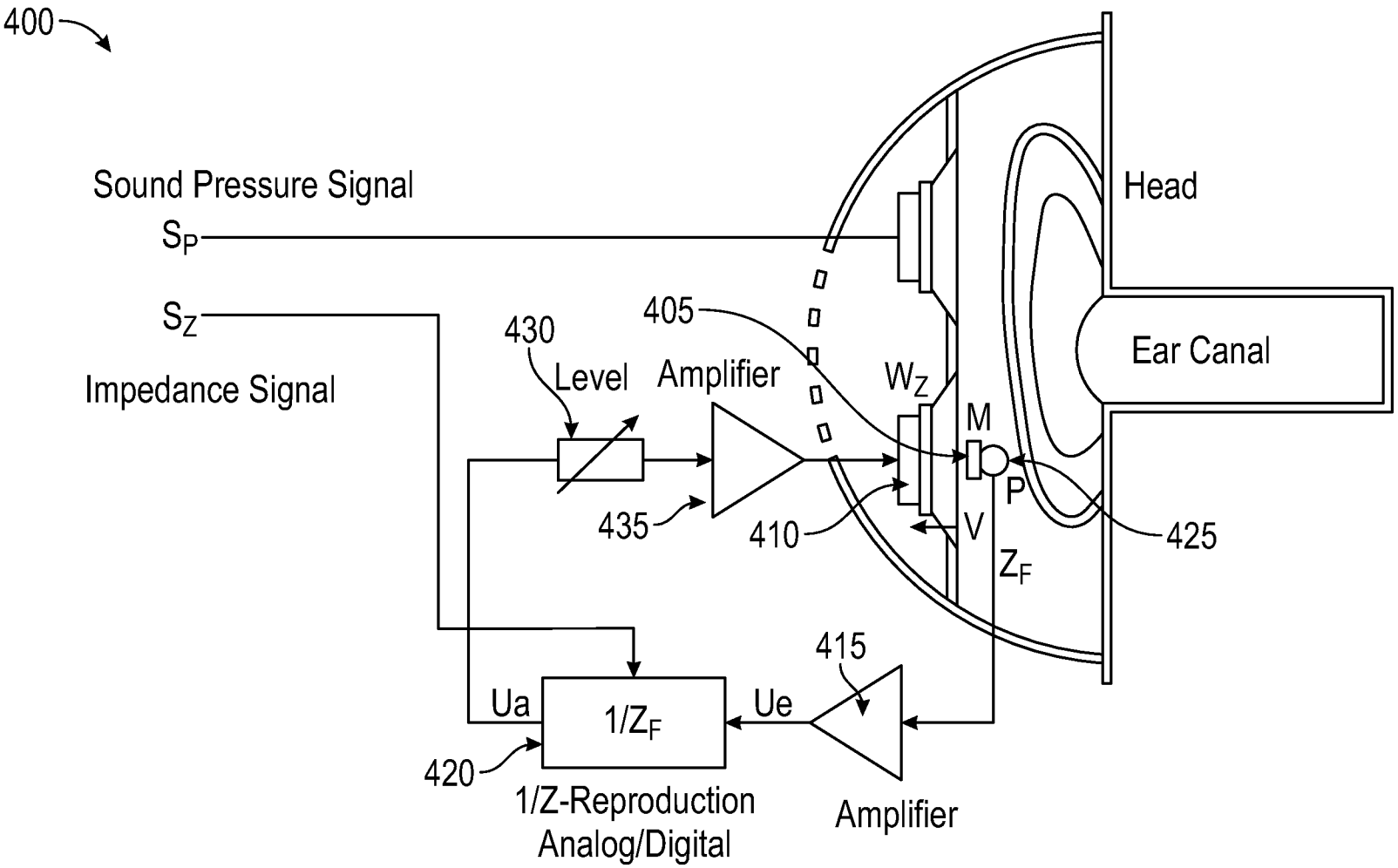
FIG. 4 illustrates a block diagram of a system for modeling sound field impedance with an active electroacoustic system, in accordance with features of the embodiments.

According to a further embodiment and with reference to FIG. 4, modeling of the sound field impedance with active electroacoustic systems 400 is provided. A system 400 comprises a variable resistor 430 and amplifier 435, a microphone 405, sound transducer 410, amplifier 415 and a reproduction function 420 that can be used to model acoustic impedances. Simple examples that can be realized analogously are masses, springs, flow resistances or resonators. Digital networks are considerably more versatile but require very low latencies. The principle is based on the modeling of the relationship between pressure and speed in the $K_H$ pressure chamber. The pressure signal 425 proportionality of the microphone M 405 and the signal membrane speed proportionality of the transducer $W_z$ are important for the correct functioning. A reproduction function describes the reciprocal of the desired acoustic impedance $Z_F$ in the form of a transfer function $U_a/U_e$=v/p=l/$Z_F$. The reproduction function reacts to the pressure signal at the input with a speed signal at the output. This signal controls the converter $W_z$, the membrane of which operates at a proportional speed. If the amount of moved air is large enough, it determines the sound field in the headphones. The reproduction can also have a further input with which the form of the transfer function can be controlled.

In the following, and with reference to FIGS. 5A-5C, an embodiment for a function for analog reproduction of sound field impedances in headphones is shown. In a first approximation, the sound field at the ear of the human head in the free sound field and at low frequencies can be described as a plane wave and a scattered wave that is reflected by a sphere that is regarded as "breathing".

Figure 5A:
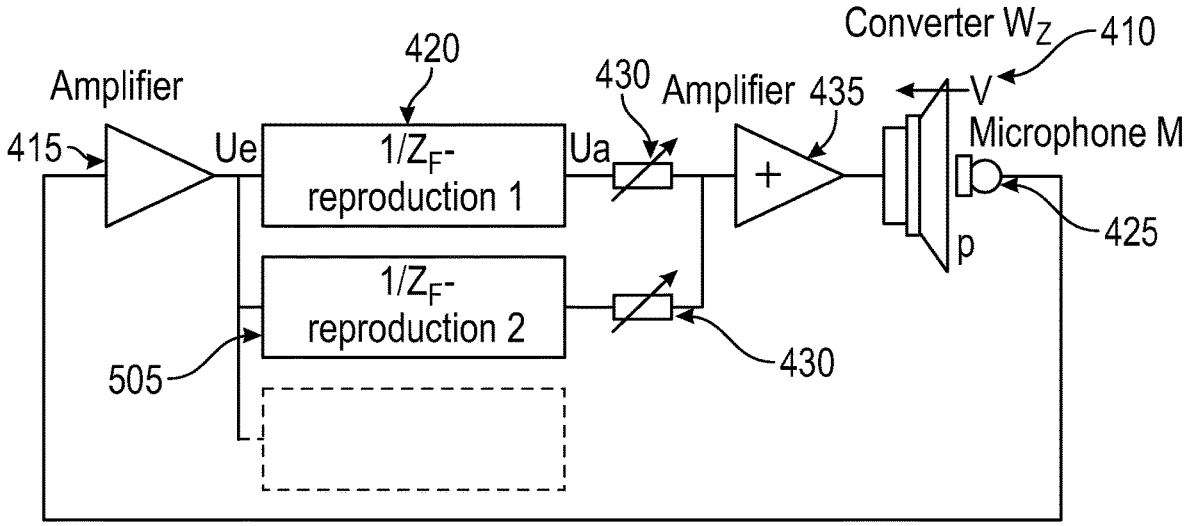
FIG. 5A illustrates a system for analog reproduction of sound field impedances in headphones, in accordance with features of the embodiments.
Figure 5B:
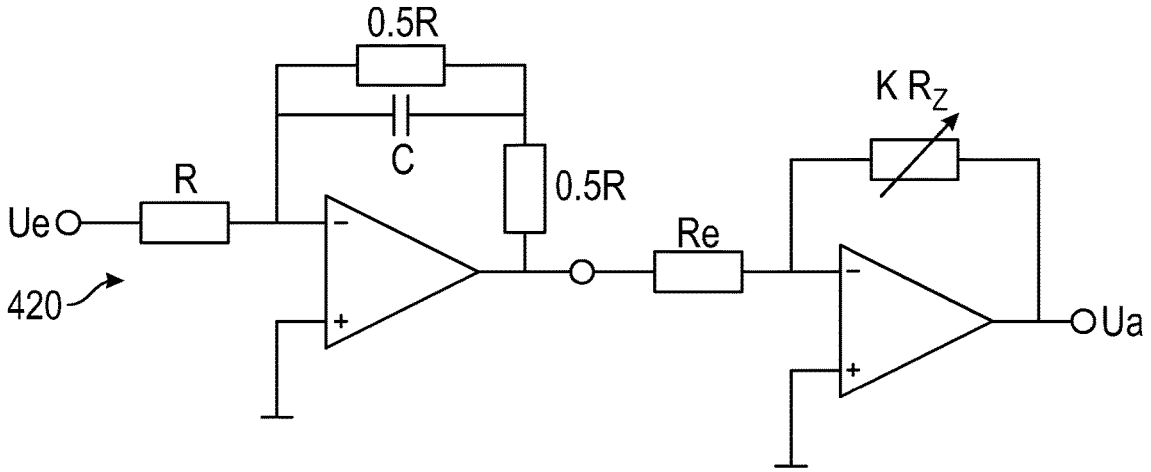
FIG. 5B illustrates a block diagram of a reproduction system, in accordance with features of the embodiments.

With respect to FIG. 5A, the ratio of $U_a$ to $U_e$ is given by equation (4):

$$\frac{Ua}{Ue} = k\frac{1+\frac{1}{f0.225wCR}}{2+\frac{1}{f0.25wCR}}\frac{v}{p} = \frac{1}{Z_f} = \frac{1}{Z_0}\frac{1+\frac{1}{jk_0a}}{2+\frac{1}{jk_0a}} \tag{4}$$

Where 0.25 $W_{CR}$=w a/$X_0$=$K_{0A}$; A=head radius; $C_0$=speed of sound; and $K_0$=wave number.

A sound pressure is generated at the radiation impedance of the "breathing" ball, which is superimposed on the plane wave. The resulting sound field impedance $Z_F$ is given by equation (5) as follows:

$$ZF = \frac{p}{v} = Z_0\frac{2+\frac{1}{fk_0a}}{1+\frac{1}{fk_0a}} \tag{5}$$

The following example shows what an analog replica of 1/v can look like. The example shows an additional reproduction 2 505 of an interference which leads to a minimum in the sound pressure.

Figure 5C:
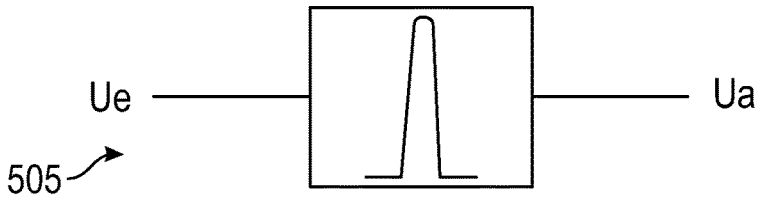
FIG. 5C illustrates a block diagram of a reproduction system signal, in accordance with features of the embodiments.

It should be noted as illustrated in FIG. 5C, the sound impedance can be influenced inn narrow bandwidths with bandwidth, amplification, and resonance frequency such that the characteristic sound pressure minimum occurs.

Figure 6A:
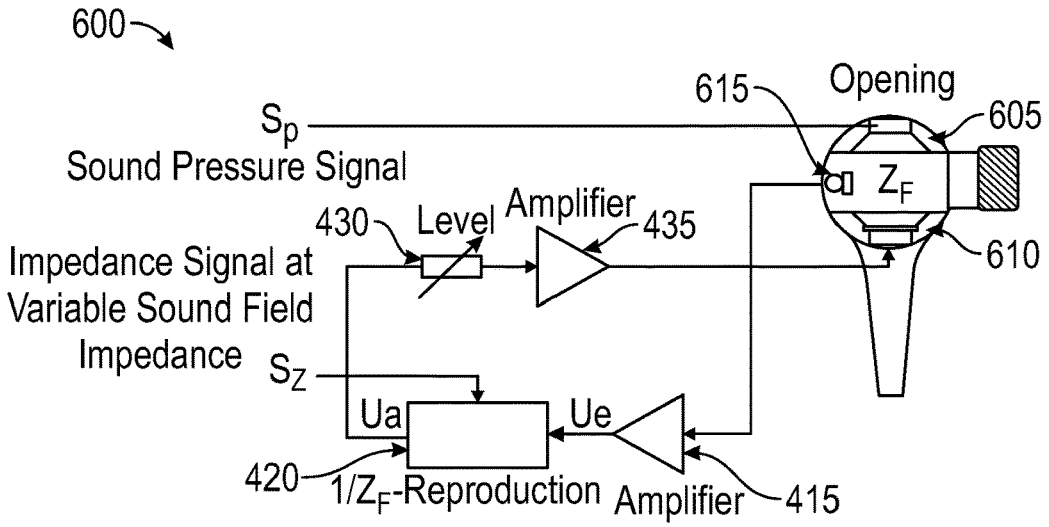
FIG. 6A illustrates an earphone, in accordance with features of the embodiments.
Figure 6B:
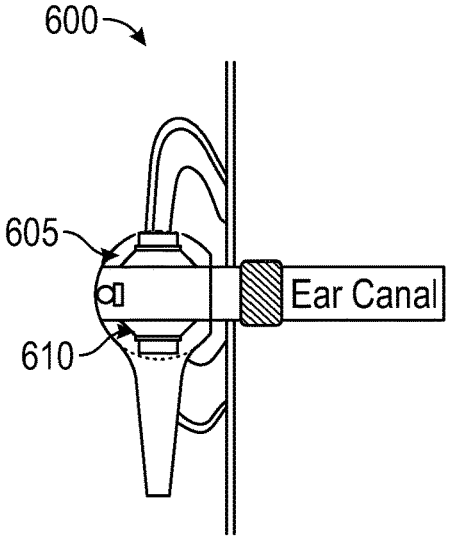
FIG. 6B illustrates a transducer arrangement in an earphone, in accordance with features of the embodiments.
Figure 6C:
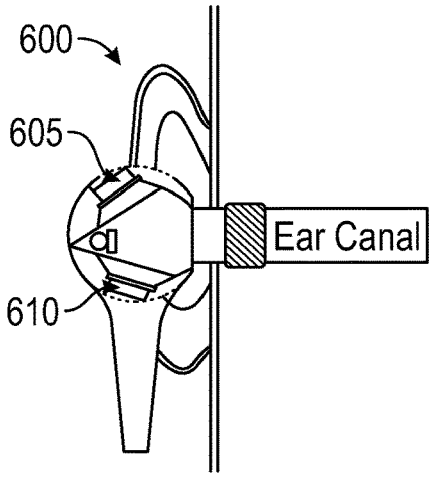
FIG. 6C illustrates a transducer arrangement in an earphone, in accordance with features of the embodiments.
Figure 6D:
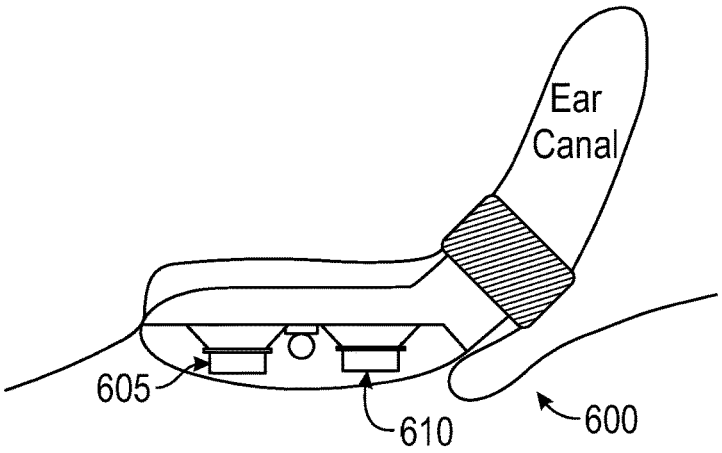
FIG. 6D illustrates a transducer arrangement in an earphone, in accordance with features of the embodiments.

Further according to the invention and with reference to FIGS. 6A-6D, an earphone 600 is proposed. The active electroacoustic systems for influencing the sound field impedance are particularly interesting for earphones. The design of the earphones 600 is important here, since two sound transducers 605 and 610 and a microphone 615 are to be accommodated in such a space-saving manner that they can still be comfortably worn by the listener. Various arrangements of the sound transducers in an earphone are also shown in FIGS. 6B-6D.

Thus, in certain embodiments, an apparatus for acoustic reproduction is disclosed, wherein the apparatus is provided with a first electroacoustic sound transducer for generating a sound field, the first electroacoustic sound transducer comprising an input for receiving an electrical signal for generating the corresponding sound field, characterized in that the apparatus further comprises a device which is configured to enter into an acoustic interaction with the generated sound field of the first electroacoustic sound transducer in order to generate a modified sound field, wherein the modified sound field has a predetermined acoustic impedance value. The device can be at least one acoustic resonator and/or at least one further electroacoustic sound transducer.

In an embodiment, the first electroacoustic sound transducer and/or the further electroacoustic sound transducer is configured to receive an electrical signal based on impedance information and can convert it into an acoustic signal so that the modified acoustic field has a predetermined acoustic impedance value through the corresponding acoustic interaction.

In an embodiment, the at least one acoustic resonator is designed as a recess or as a Helmholtz resonator, these being implemented particularly at the housing of the apparatus.

In an embodiment, the first electroacoustic sound transducer and/or the further electroacoustic sound transducer and/or the acoustic resonator are controllable by a corresponding electrical signal in order to set different acoustic impedance values in the modified sound field.

In an embodiment, the apparatus has a measuring unit, in particular a microphone for measuring a sound field parameter in order to be able to derive a given impedance value in the sound field therefrom, to enable the generation of a subsequent electrical adaptation signal.

In an embodiment, the apparatus is designed as headphones or as earphones.

In an embodiment, the position and/or the orientation of the first electroacoustic sound transducer and/or of the further electroacoustic sound transducer and/or of the acoustic resonator is designed to be changeable and in particular can be changed by a suitable electrical signal and adjusted if necessary.

In another embodiment, a signal processing unit is disclosed for processing signals for acoustic reproduction, characterized in that the signal processing unit is configured to process a further signal for acoustic interaction with a first sound field, based on a first signal which is provided for generating the first sound field, to generate a modified sound field, wherein the modified sound field has a predetermined acoustic impedance value. The signal processing unit can provide a factor based on at least one sound pressure signal and/or one sound velocity of the first signal to generate a modified sound field, wherein the modified sound field has a predetermined acoustic impedance value. In an embodiment, the sound pressure signal and/or the sound velocity is derived by a measurement, particularly from of at least one microphone. In an embodiment, the signal processing unit is configured to process an impedance signal for the impedance signal being providable to a sound transducer. In an embodiment, the modified sound field has a temporally predetermined variable acoustic impedance value. In an embodiment, the signal processing unit is configured to process further relevant acoustic parameters, in particular geometric parameters of a headphone or an earphone, in order to set the predetermined acoustic impedance value for the modified sound field.

In another embodiment, data for acoustic reproduction is provided, characterized in that the data has data elements for acoustic interaction with a first sound field, wherein the data elements are configured to generate a modified sound field, the modified sound field having a predetermined acoustic impedance value. In an embodiment, the data elements are configured to be converted into a corresponding electrical signal in order to be reproduced in a later step by an acoustic resonator and/or by at least one electroacoustic sound transducer. In an embodiment, the data elements comprise impedance information. The data can further comprise control data for controlling the acoustic resonator and/or the at least one electroacoustic sound transducer.

In certain embodiments data can be generated by one of the signal processing units according for acoustic reproduction.

In certain embodiments, a processing unit for processing and/or reproducing the data is disclosed, in particular a smartphone, a notebook, a laptop, a tablet PC, a personal computer, a wireless transmitter or a server.

In certain embodiments, a sound transducer is configured to reproduce a generated signal by a signal processing unit according for processing and/or reproducing data.

In certain embodiments, a software product is disclosed which can be stored on a storage medium and processed by an electronic data processing unit to implement a signal processing unit for processing and/or reproducing the data and/or to generate or reproduce data.

In certain embodiments, a method for acoustic reproduction is disclosed the method comprising the following steps: generating a first sound field; and generating a second signal for acoustic interaction with the first sound field in order to generate a modified sound field, wherein the modified sound field has a predetermined acoustic impedance value.

The invention claimed is:

1. An apparatus for acoustic reproduction comprising:

a first electroacoustic sound transducer for generating a sound field, the first electroacoustic sound transducer comprising an input for receiving an electrical signal for generating the sound field; and a device configured to enter into an acoustic interaction with the generated sound field of the first electroacoustic sound transducer in order to generate a modified sound field, the device comprising one of: at least one acoustic resonator; and at least one further electroacoustic sound transducer, wherein the modified sound field has a predetermined acoustic impedance value, the device being configured to receive impedance information and to convert the impedance information into an acoustic signal so that a modified acoustic field has a predetermined acoustic impedance value through a corresponding acoustic interaction.

2. The apparatus according to claim 1, wherein the at least one acoustic resonator comprises one of: a recess resonator and a Helmholtz resonator, the at least one acoustic resonator configured at a housing of the apparatus.

3. The apparatus according to claim 1, wherein at least one of the first electroacoustic sound transducer, the at least one further electroacoustic sound transducer, and/or the at least one acoustic resonator are controllable in order to set different acoustic impedance values in the modified sound field.

4. The apparatus of claim 1 further comprising:

a measuring unit, in particular a microphone for measuring a sound field parameter in order to be able to derive a given impedance value in the sound field therefrom, to enable generation of a subsequent electrical adaptation signal.

5. The apparatus according to claim 1, wherein the apparatus is designed as at least one of:

headphones; and/or earphones.

6. The apparatus according to claim 1, wherein a position and/or an orientation of at least one of the first electroacoustic sound transducer, the at least one further electroacoustic sound transducer, and/or of the at least one acoustic resonator is designed to be changeable.

7. A signal processing unit for acoustic reproduction, the signal processing unit being configured to:

process an acoustic interaction with a first sound field, based on a first electroacoustic sound transducer and a second electroacoustic sound transducer, provided for generating the first sound field;

generate a modified sound field, wherein the modified sound field has a predetermined acoustic impedance value;

measure a current impedance value in the first sound field with a control loop in order to implement subsequent readjustment of the modified sound field; and process further relevant acoustic parameters, in particular geometric parameters of a headphone or an earphone, in order to set the predetermined acoustic impedance value for the modified sound field.

8. The signal processing unit according to claim 7, the signal processing unit being further configured to:

provide a factor based on at least one sound pressure and/or one sound velocity to generate a modified sound field, wherein the modified sound field has a predetermined acoustic impedance value.

9. The signal processing unit according to claim 8 further comprising:

at least one microphone, configured to measure the sound pressure and the sound velocity.

10. The signal processing unit according to claim 7 further comprising:

a sound transducer wherein the signal processing unit is configured to process an impedance signal provided by the sound transducer.

11. The signal processing unit according to claim 7, wherein the modified sound field has a temporally predetermined variable acoustic impedance value.

12. The signal processing unit according to claim 7 wherein the signal processing unit comprises at least one of:

a smartphone;

a notebook;

a laptop;

a tablet PC;

a personal computer;

a wireless transmitter; and/or a server.

13. A method for acoustic reproduction, the method comprising:

generating a first sound field with a first electroacoustic sound transducer;

generating a second signal for acoustic interaction with the first sound field;

generating a modified sound field from the acoustic interaction between the second signal and the first sound field, wherein the modified sound field has a predetermined acoustic impedance value;

receiving impedance information; and converting the impedance information into an acoustic signal so that the modified sound field has the predetermined acoustic impedance value.

14. The method of claim 13 further comprising:

setting different acoustic impedance values in the modified sound field.

15. The method of claim 13 further comprising:

measuring a sound field parameter with a microphone; and deriving a given impedance value therefrom.

16. The method of claim 15 further comprising:

generating a subsequent electrical adaptation signal according to the sound field parameter and the derived given impedance value.

* * * * *